United States Patent [19]

Kim et al.

[11] Patent Number: 5,049,106

[45] Date of Patent: Sep. 17, 1991

[54] SELF-CONTAINED, SELF-INFLATING NOVELTY BALLOON

[76] Inventors: Sunyong Kim, 105 Valley Forge, St. Charles, Mo. 63303; Dae W. Lee, 1575 N. Warson Rd., St. Louis, Mo. 63132

[21] Appl. No.: 532,384

[22] Filed: Jun. 4, 1990

[51] Int. Cl.[5] ..... A63H 3/06

[52] U.S. Cl. ..... 446/220; 116/210; 116/DIG. 9

[58] Field of Search ..... 446/220, 222, 221, 224, 446/225, 226; 116/210, DIG. 8, DIG. 9; 244/31, 33; 141/313

[56] References Cited

U.S. PATENT DOCUMENTS

| | | | |
|---|---|---|---|
| 827,350 | 7/1906 | Crofford | 116/DIG. 9 |
| 1,702,974 | 2/1929 | MacDonald | 446/222 |
| 2,646,019 | 7/1953 | Chetlan | 446/220 |
| 2,862,531 | 12/1958 | Walker | 446/220 X |
| 3,174,455 | 3/1965 | Peterson | 446/220 X |
| 3,310,024 | 3/1967 | McConnell | 116/210 |
| 4,917,041 | 4/1990 | Weiswurm | 446/220 |

*Primary Examiner*—Richard J. Johnson

*Attorney, Agent, or Firm*—Senniger, Powers, Leavitt & Roedel

[57] ABSTRACT

A self-contained, self-inflating balloon unit comprising a closed, inflatable balloon, a cannister containing compressed gas, at least partly inside the balloon, and a device for releasing the compressed gas from the cannister into the balloon to inflate the balloon. The balloon comprises an inflatable body portion and a neck portion, and the cannister is located in the neck portion. The cannister is preferably slidably mounted in a sleeve in the neck portion of the balloon. The sleeve includes a pin for rupturing the cannister when the cannister is urged against it. A one-way valve allows the gas to inflate the body portion but prevents its escape.

In some embodiments the unit also includes a tether which is connected at one end to the sleeve and at the other end to the cannister. After the balloon is inflated, the cannister can be removed from the sleeve, extending the tether. The empty cannister serves as a handle for the tether. The balloon and the cannister may be sized so that the empty cannister serves as an anchor for the balloon.

18 Claims, 2 Drawing Sheets

36
22
26
20
34
30
32
24
28

36
26
22
34
20
30
32
24
28
38

SELF-CONTAINED, SELF-INFLATING NOVELTY BALLOON

BACKGROUND OF THE INVENTION

This invention relates to novelty balloons, and more particularly to a self-contained, self-inflating novelty balloon.

At present, helium-filled balloons and other balloons containing gases which make them buoyant under normal atmospheric conditions are of necessity sold to consumers already inflated with the buoyant gas. This causes a number of difficulties. The consumer purchasing such a novelty balloon for a party or other event must transport the already-filled balloon from the store where it was purchased to the place of the upcoming festivities. Since inflated balloons are notoriously bulky, this is not always an easy task. Generally, only a few such balloons will fit into the typical family sedan, thus limiting the number of balloons which may be transported in one trip. Also, once inflated, the balloons must be properly anchored to avoid having them launched into the clouds and lost. Once inflated, the chances of the balloon being punctured are also increased.

Another problem caused by the requirement of inflating novelty balloons at the point of purchase is that most such balloons have a limited time-span. Accordingly, they generally must be purchased just a short time before the event at which they are to be used. This often results in the inconvenience of last-minute scrambling to locate a store where such balloons may be inflated, and organizing one's schedule to accommodate the restrictions imposed by such a regime.

What is needed is a novelty balloon which the consumer can inflate when and where needed rather than solely at the point of purchase.

SUMMARY OF THE INVENTION

It is among the objects of the present invention to provide a novelty balloon unit that can be quickly and easily inflated by the consumer; to provide such a balloon unit that can be filled with a buoyant gas; and to provide such a balloon unit that has a self-contained gas supply so that it can be inflated without a special gas supply. It is among the objects of at least some of the embodiments of this invention to provide such a balloon unit that includes an integral tether and handle; and to provide such a balloon unit in which the handle can anchor the balloon.

Generally the balloon unit of the present invention comprises a closed, inflatable balloon, a cannister containing compressed gas, at least partly inside the balloon, and means for releasing the compressed gas from the cannister into the balloon to . inflate the balloon. The balloon is preferably of the type comprising an inflatable body portion and a neck portion, and the cannister is preferably contained in the neck portion.

The balloon unit may include a sleeve in the neck portion of the balloon in which the cannister can slide. The sleeve includes means for rupturing the cannister to release the into the balloon when the cannister is urged against it. The sleeve may also include a one-way valve means that allows gas from the ruptured cannister to fill the body portion of the balloon, but does not allow the gas to escape from the balloon body.

According to at least one embodiment of this invention, the balloon unit may include a tether between the cannister and the sleeve, so that the cannister can be separated from the balloon after the balloon is inflated and used as a handle for the tether to retain the balloon. The canister preferably contains a buoyant gas, and is preferably sized relative to the balloon that the weight of the empty cannister is greater than the buoyant force of the inflated balloon, so that the cannister can anchor the balloon.

Thus the novelty balloon unit of the present invention provides a balloon that can be quickly and easily inflated by the consumer. The unit provides a self-contained gas supply to fill the balloon, eliminating the need for a separate gas supply. According to some of the embodiments of this invention, the balloon unit includes an integral tether to retain the balloon. In some of these embodiments the cannister can be separated and used as a handle or an anchor for the balloon.

These and other features and advantages will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figures 1, 2:
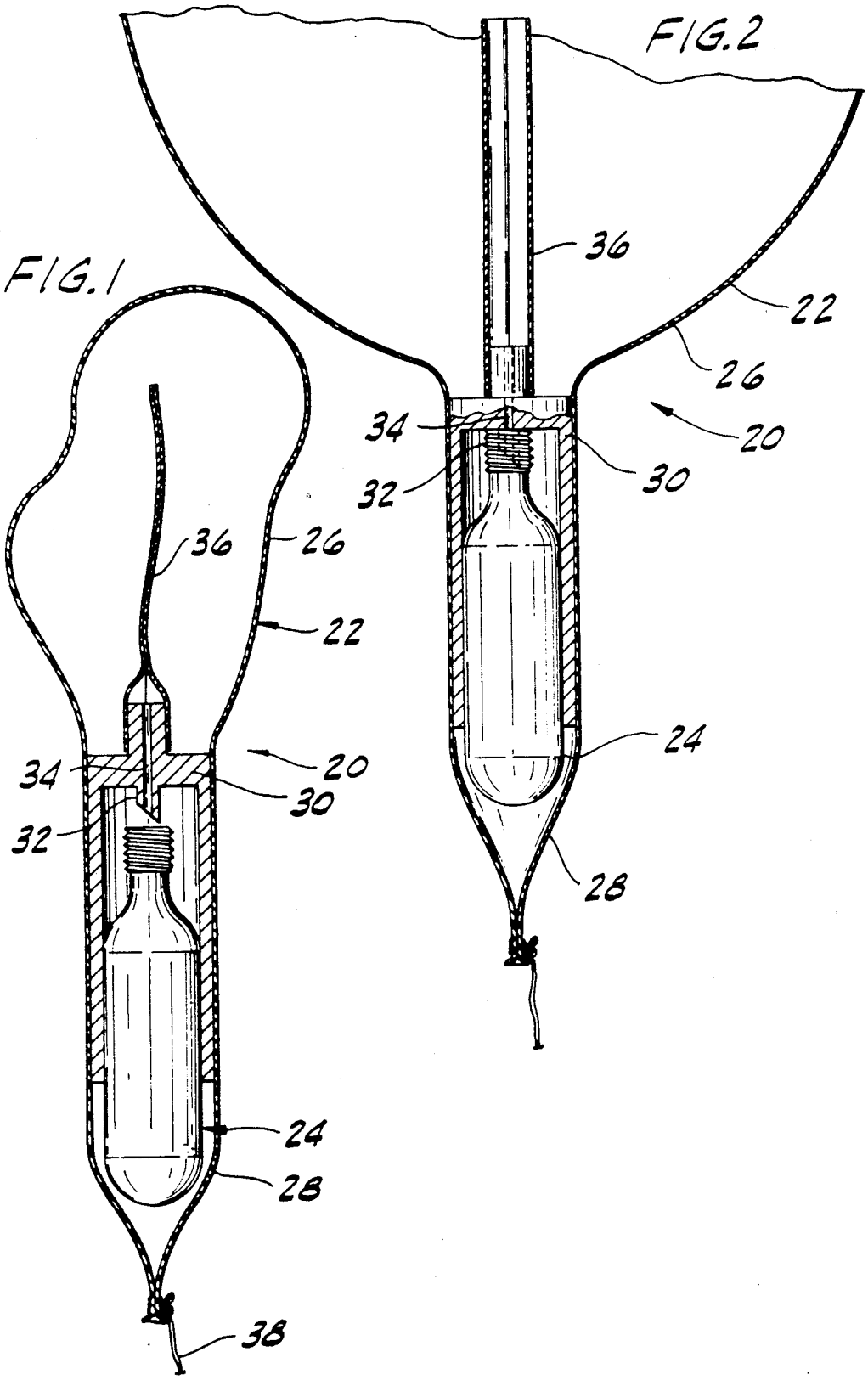
FIG. 1 is a vertical cross-sectional view of a first embodiment of a balloon unit constructed according to the principles of this invention, shown before inflation.
FIG. 2 is a partial vertical cross-sectional view of the first embodiment, while the gas is being released from the cannister to inflate the balloon.

A first embodiment of a self-contained, self-inflating balloon unit constructed according to the principles of this invention, indicated generally as 20, is shown in FIG. 1 in its pre-inflation condition. The balloon unit 20 comprises a closed, inflatable balloon 22, and a cannister 24, containing compressed gas, at least partly inside the balloon. The balloon 22 may be made from a variety of rubbers or plastics, although a thin plastic film such as Mylar TM is preferable. The cannister 24 preferably contains a lighter-than-air gas, such as helium, in sufficient quantity to inflate the balloon 22 to be buoyant in normal atmospheric conditions. In this first embodiment, the cannister 24 is preferably contained entirely within the balloon 22. The balloon unit 20 also comprises means for releasing the compressed gas from the cannister 24 into the balloon inflate the balloon.

The means for releasing the compressed gas can comprise some type of switch or valve that opens the cannister 24. However, the cannister 24 is preferably of the type comprising a rupturable portion and the means for releasing the gas comprises some means for puncturing the rupturable portion to release the gas.

The balloon is of the type comprising an inflatable body portion 26 and a neck portion 28. The cannister 24 is located in the neck portion 28. The balloon unit 20 may further include a sleeve 30 in the neck portion 28 of the balloon 22. The sleeve 30 may be made of a rigid, lightweight plastic. The cannister 24 is slidably received in the sleeve 30. The sleeve 30 includes means, such as a follow beveled pin 32 inside the sleeve, at the top, for rupturing the cannister 24 to release the gas into the balloon when the cannister is urged against it. The pin 32 has a central passage 34 for conducting gas from the cannister to the interior of the balloon body portion 26. The sleeve 30 protects the cannister 24, and guides it toward the rupturing means.

The sleeve 30 also may include one-way valve means connected with the central passage 34 in the pin 32 that allows gas from the cannister to fill the body portion 26 of the balloon, but does not allow the gas to escape from the body portion This one-way valve means might be, for example, a flattened tube 36 over a boss of the outside of the top of the sleeve 30. The tube 36 is composed of a flexible material, such as a soft plastic. When the cannister 24 is punctured, the gas passing through the passage 34 forces the tube 36 to remain open (see FIG. 2). However, once the flow of gas from the cannister 24 stops, the tube 36 collapses on itself, preventing gas from escaping from the body portion 26 of the balloon through the passage 34.

In this first embodiment, the balloon and the cannister are preferably relatively sized so that if the balloon is inflated with a lighter-than-air gas, the buoyant force of the inflated balloon is sufficient to lift the entire balloon unit, i.e., including the sleeve and the empty cannister. Of course, the unit 20 could be constructed so that the empty container can be removed after the gas is discharged into the balloon.

A string 38 may be provided on the balloon, particularly if i is filled with a buoyant gas, to retain the balloon.

Figure 3:
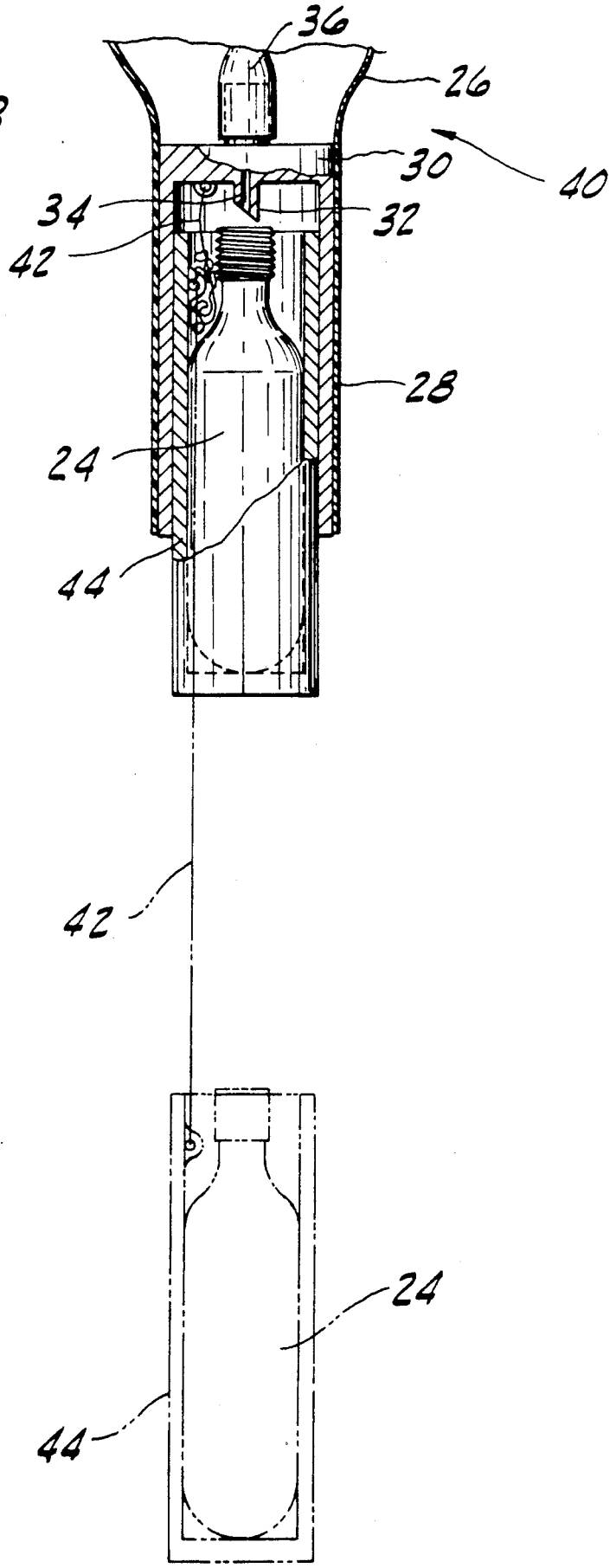
FIG. 3 is a partial vertical cross-sectional view of a second embodiment of a balloon unit constructed according to the principles of this invention.

A second embodiment of a self-contained, self-inflating balloon unit constructed according to the principles of this invention, indicated generally as 40, is shown in FIG. 3 in its pre-inflated condition. The balloon unit 40 is similar in construction to the balloon unit 20, and corresponding parts are identified with corresponding reference numerals. However, unlike unit 20, in unit 40 the cannister 24 is not completely enclosed in the balloons 22. Furthermore, unit 40 includes a tether 42 between the cannister 24 and the sleeve 30, so that the cannister can be separated from the balloon after the balloon is inflated and used as a handle for the tether to retain the balloon. The cannister 24 is preferably contained in a plunger member 44 that is telescopingly received in the sleeve 30 for urging the cannister against the rupturing means. The tether 42 preferably extends between the plunger member 44 and the sleeve 30, and before inflation of the balloon it is stored in the sleeve, above the plunger member, already attached to the sleeve and the plunger member so that the plunger member can be separated from the balloon 22 after the balloon is inflated, and used as a handle for the tether to retain the balloon.

The cannister 24 is preferably filled with a lighter-than-air gas, for example helium. The balloon 22 and the cannister 24 are preferably relatively sized that the weight of the plunger member 44 and the empty cannister 24 is greater than the buoyant force of the inflated balloon, so that the plunger member 44 can anchor the balloon. Of course if there is no plunger member, the balloon and the cannister can be relatively sized so that the weight of the empty cannister is greater than the buoyant force of the inflated balloon, so that the cannister can anchor the balloon.

OPERATION

In operation the balloon unit 20 of the first embodiment is actuated by urging the cannister 24 against the pin 32 in the sleeve 30 to rupture the cannister and release the compressed gas. The gas from the cannister 24 inflates the balloon body 26. The buoyant force of the inflated balloon is preferably sufficient to lift the entire balloon unit 20. Alternatively, the balloon unit 20 may be constructed so that the empty cannister can be removed after the balloon 22 is inflated. The one-way valve means 36 prevents the balloon 22 from deflating after the cannister is removed from the sleeve 30.

In operation the balloon unit 40 of the second embodiment is actuated by urging the plunger member 44 into the sleeve 30 to rupture the cannister 24 against the pin 32. The gas escaping from the ruptured cannister 24 inflates the balloon 22. When the inflation is complete, the plunger member 44 is pulled from the sleeve 30 extending the tether 42, as shown in phantom in FIG. 3. The one-way valve means 36 prevents the balloon 22 from deflating. The plunger member 44 makes a convenient handle to hold the tether 42 to retain the balloon 22. The balloon 22, cannister 24, and plunger member 44 may be relatively sized so that the weight of the plunger member and the empty cannister is sufficient to anchor the balloon.

Thus a balloon unit constructed according to the principles of this invention provides a self-contained, self-inflating novelty balloon that can be inflated any time, any where, without the need for a special gas supply or special equipment. Some embodiments include an integral tether to retain the balloon 22.

In view of the above, it will be seen that the several objects of the invention are achieved and other advantages results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A self-contained, self-inflating novelty balloon unit comprising:
   - a closed, inflatable novelty balloon;
   - a canister containing compressed gas, entirely inside the balloon;
   - means for releasing the compressed gas from the canister into the balloon to inflate the balloon.

2. The balloon unit according to claim 1 wherein the cannister contains a lighter-than-air gas in sufficient quantity to make the entire balloon unit buoyant.

3. The balloon unit according to claim 1 wherein the balloon comprises an inflatable body portion and a neck portion, and wherein the cannister is located in the neck portion.

4. The balloon unit according to claim 3 wherein the cannister is contained entirely within the neck portion.

5. The balloon unit according to claim 3 further comprising a sleeve in the neck portion of the balloon in which the cannister can slide, the sleeve including means in the sleeve for rupturing the cannister to release the gas into the balloon when the cannister is urged against it.

6. The balloon unit according to claim 5 furhter comprising a one-way valve means on the sleeve that allows gas from the cannister to fill the body portion, but does not allow the gas to escape from the body portion.

7. The balloon unit according to claim 5 further comprising a plunger member, containing the cannister, telescopingly received in the sleeve for urging the cannister against the rupturing means.

8. A self-contained, self-inflating novelty balloon unit comprising:

a novelty balloon having an inflatable body portion and a neck portion;

a sleeve in the neck portion;

a canister containing compressed gas, slidably received in the sleeve, at least partly inside the balloon;

means in the sleeve for rupturing the canister to release the gas to inflate the balloon, when the canister is urged against it;

a tether connected at one end to the canister and at the other end to the sleeve, and contained between the canister and the sleeve, so that the canister can be separated from the sleeve after the balloon is inflated and used as a handle for the tether to retain the balloon.

9. The balloon unit according to claim 8 wherein the cannister is filled with a lighter-than-air gas, and wherein the balloon and the cannister are relatively sized so that the weight of the empty cannister is greater than the buoyant force of the inflated balloon, so that the empty cannister can anchor the balloon.

10. The balloon unit according to claim 8 further comprising a plunger member, containing the canister, telescopingly received in the sleeve for urging the canister against the rupturing means.

11. The balloon unit according to claim 10 wherein the canister is filled with a lighter-than-air gas, and wherein the balloon and the canister are relatively sized so that the weight of the plunger member and empty canister is greater than the buoyant force of the inflated balloon, so that the plunger member and empty canister can anchor the balloon.

12. A self-contained, self-inflating novelty balloon unit comprising:

a novelty balloon having an inflatable body portion and a neck portion;

a sleeve in the neck portion;

a canister containing compressed gas slidably received in the sleeve, entirely inside the balloon;

means in the sleeve for rupturing the canister to release the gas to inflate the balloon, when the canister is urged against it.

13. The balloon unit according to claim 2 wherein the canister contains lighter-than-air gas in sufficient quantity to make the entire balloon unit buoyant.

14. The balloon unit according to claim 12 wherein the cannister is enclosed with the balloon.

15. The balloon unit according to claim 12 further comprising a one-way valve means on the sleeve that allows gas from the cannister to fill the body portion, but does not allow the gas to escape from the body portion.

16. The balloon unit according to claim 12 further comprising a plunger member, containing the cannister, telescopingly received in the sleeve for urging the cannister against the rupturing means.

17. The balloon unit according to claim 16 further comprising a tether connected at one end to the plunger member and at the other end to the sleeve, and contained between the plunger member and the sleeve, so that the plunger member can be separated from the sleeve after the balloon is inflated and used as a handle for the tether to retain the balloon.

18. The balloon unit according to claim 17 wherein the cannister is filled with a lighter-than-air gas, and wherein the balloon and the cannister are relatively sized so that the weight of the plunger member and empty cannister is greater than the buoyant force of the inflated balloon, so that the plunger member can anchor the balloon.

* * * * *